US007726979B2

(12) United States Patent
Lei et al.

(10) Patent No.: US 7,726,979 B2
(45) Date of Patent: Jun. 1, 2010

(54) LOW PROFILE BOARD-TO-BOARD ELECTRICAL CONNECTOR HAVING TERMINAL TAILS ARRANGED IN MIDDLE OF SIDE WALL

(75) Inventors: Gao-Bing Lei, Shenzhen (CN); Nan Hu, Shenzhen (CN)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 12/545,087

(22) Filed: Aug. 21, 2009

(65) Prior Publication Data

US 2010/0048041 A1 Feb. 25, 2010

(30) Foreign Application Priority Data

Aug. 21, 2008 (CN) ..... 200820039416

(51) Int. Cl.
*H01R 12/00* (2006.01)

(52) U.S. Cl. ..... 439/74

(58) Field of Classification Search ..... 439/74, 439/660, 733.1, 862
See application file for complete search history.

(56) References Cited

U.S. PATENT DOCUMENTS 6,338,630 B1 * 1/2002 Dong ..... 439/74
6,884,089 B2 4/2005 Obikane et al.
2006/0264074 A1 * 11/2006 Chang et al. ..... 439/74

* cited by examiner

*Primary Examiner*—Tho D Ta
(74) *Attorney, Agent, or Firm*—Andrew C. Cheng; Wei Te Chung; Ming Chieh Chang

(57) ABSTRACT

An electrical connector includes an insulating housing having sidewalls and end walls for defining a receiving groove, a number of contacts retained in the insulating housing, the contact including a mating beam extending into the receiving groove and a retaining beam retained in the sidewall. The contact further includes a tail portion extending out of the insulating housing from the retaining beam and a soldering portion formed on a tip end of the tail portion. The soldering portion is located between a highest point and a lowest point of the contact so that the height of the electrical connector upon a PCB can be reduced, which can also reduce the mating-height of the electrical connector after mating with a mating connector.

13 Claims, 4 Drawing Sheets

LOW PROFILE BOARD-TO-BOARD ELECTRICAL CONNECTOR HAVING TERMINAL TAILS ARRANGED IN MIDDLE OF SIDE WALL

BACKGROUND OF THE INVENTION

1. Field of the Invention

The present invention relates to an electrical connector, and more particularly to a low profile electrical connector in which a terminal tail is arranged between a top and a lower surface of a housing such that the housing can sink into a printed circuit board on which it is mounted.

2. Description of Related Art

An electrical connector assembly is used in an electronic device to electrically connect with two PCBs for reducing the size of the electronic device. As disclosed in U.S. Pat. No. 6,884,089 issued to Obikane on Apr. 26, 2005, the board-to-board electrical connector assembly includes a receptacle mounted on a first PCB and a plug mating with the receptacle and mounted on a second PCB. The receptacle includes an insulating housing and a plurality of contacts retained in the insulating housing. Said contact has a horizontal base portion, a mating portion extending inward and then upwardly from inside end of the base portion, a connecting portion extending upwardly from upward end of the base portion, and a soldering portion bent horizontally from the connecting portion for being soldered on the first PCB. The first PCB defines a receiving hole for receiving the receptacle, which makes the lower portion of the receptacle located under the first PCB in order to reduce the distance between the first PCB and the second PCB after the plug mates with the receptacle. However, said connecting portion and the soldering portion of the contact are L-shaped formed, besides, a pair of sidewalls of the insulating housing abut against a peripheral edge of the receiving hole of the first PCB without a gap therebetween. As a result, during the mating process of the receptacle and the plug, if the mating direction becomes unstable under an unstable external force, said L-shaped structure of the contact will fail to provide an enough flexility to absorb the external shock, which may lead a mismating between the plug and the receptacle, and even worsely, makes the L-shaped structure broken up.

So it is necessary to provide a new electrical connector to solve the problems above.

SUMMARY OF THE INVENTION

Accordingly, it is an object of the present invention to provide an electrical connector which can reduce the mating-height of the electrical connector after mating.

In order to achieve above-mentioned object, an electrical connector is provided which comprises an insulating housing having sidewalls and end walls to define a receiving room thereamong, a plurality of contacts retained in the insulating housing, the contact including a mating beam extending into the receiving room and a retaining beam retained in the sidewall; wherein the contact further includes a tail portion extending out of the insulating housing from the retaining beam and parallel to the retaining beam, said tail portion is located between a highest point and a lowest point of the contact and defines a soldering portion at a tip end thereof.

Other objects, advantages and novel features of the present invention will become more apparent from the following detailed description of the present embodiment when taken in conjunction with the accompanying drawings.

DETAILED DESCRIPTION OF THE INVENTION

The present invention shall be discussed hereinafter in terms of a preferred embodiment illustrated in the accompanying drawings. In the following description, numerous specific details are set forth in order for the reader hereof to gain a thorough understanding of the present invention. It will be obvious, however, to those skilled in the art that certain well-know elements may not be shown in detail in order to unnecessarily obscure the present invention.

Referring to FIGS. 1 to 4, an electrical connector 100 is mounted on a first PCB 300 and mating with a mating connector 200 which is mounted on a second PCB 400. The electrical connector 100 mates with the mating connector 200 electrically for establishing an electrical connection between the first PCB 300 and the second PCB 400.

Figure 1:
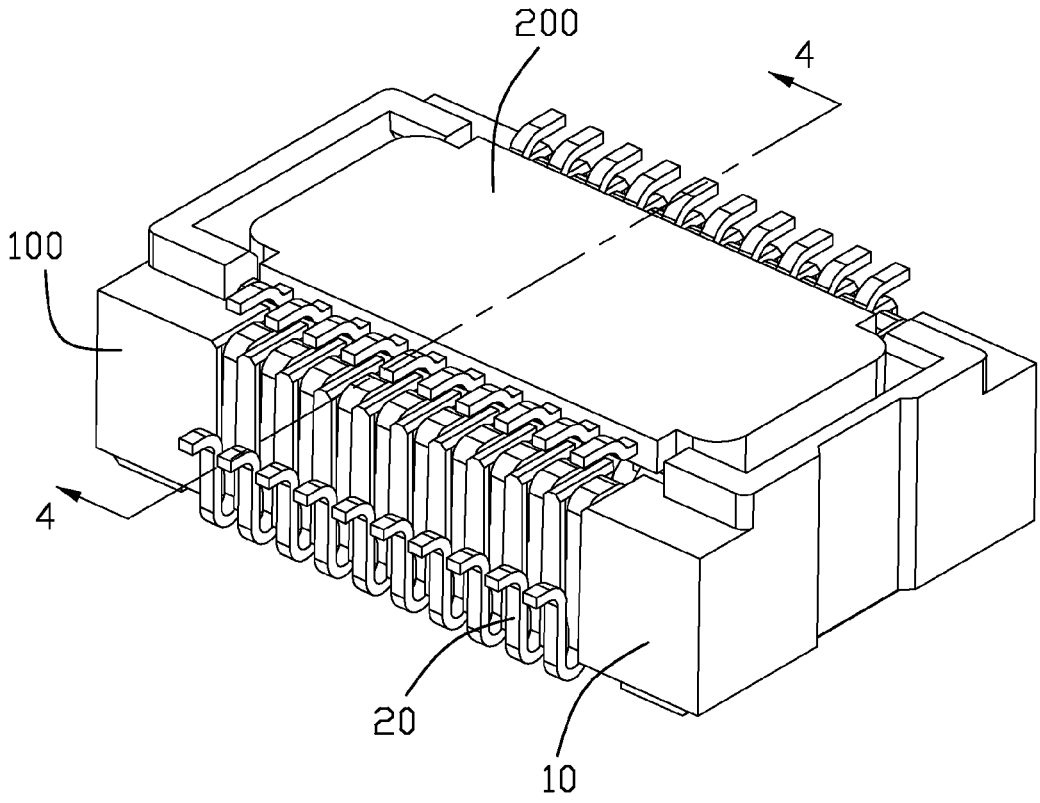
FIG. 1 is a perspective view of an electrical connector assembly in accordance with the present invention.
Figure 2:
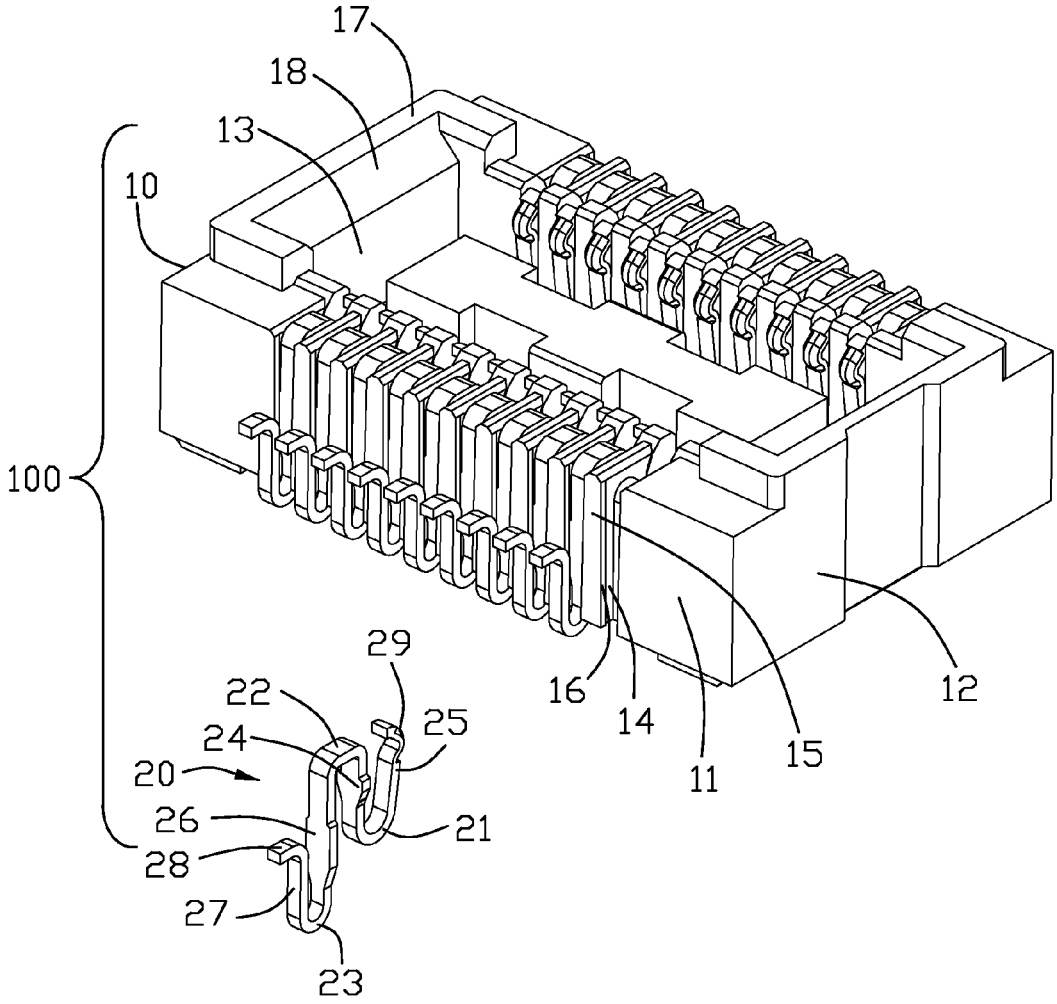
FIG. 2 is a partial exploded perspective view of one electrical connector of the electrical connector assembly of FIG. 1.
Figure 4:
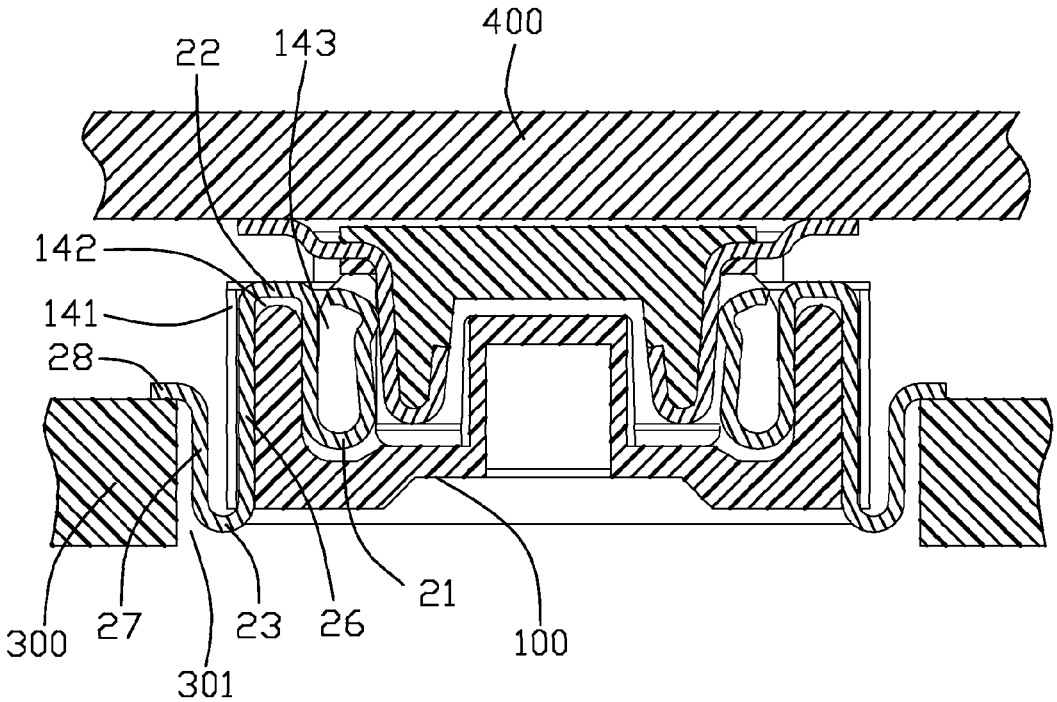
FIG. 4 is a cross-section view of the electrical connector assembly of FIG. 1 taken along 4-4 direction.

As referring to FIG. 2 and FIG. 4, the electrical connector 100 includes an insulating housing 10 and a plurality of contacts 20 retained in the insulating housing 10. Said insulating housing 10 includes a pair of longitudinal sidewalls 11 and a pair of end walls 12 connecting with said sidewalls 11. The sidewalls 11 and the end walls 12 define a receiving room 13 for receiving the mating connector 200. The sidewall 11 has a plurality of passageways 14 arranged longitudinally on a surface thereof for receiving the contacts 20. Said passageway 14 extends from an outer surface of sidewall 11 into the receiving room 13 and includes a first groove 141 depressed on said outer surface of the sidewall 11, a second groove 142 extending horizontally on a top surface of the sidewall 11 and a third groove 143 which is depressed on an inner surface of the sidewall 11 and running through to the receiving room 13. Every two adjacent passageways 14 are separated by a partition wall 15 located therebetween. The partition wall 15 defines a pair of ribs 16 at outermost edges of opposite inner face and downwardly extending. The end wall 12 has a pair of guiding portion 17 protruding upwardly from a top surface thereof. Said guiding portion 17 is located between said sidewalls 11 and formed higher than the sidewalls 11. An inclined guiding surface 18 is formed on an inner surface of the guiding portion 17 facing to the receiving room 13.

As referring to FIG. 2 and FIG. 4, the contacts 20 are downwardly assembled into the passageways 14 of the insulating housing 10 and arranged in a longitudinal direction on the sidewalls 11. The contact 20 includes a first U-shaped retaining portion 21, a second U-shaped retaining portion 23 and a horizontal connecting portion 22 connecting with said first retaining portion 21 and said second retaining portion 23. The first U-shaped retaining portion 21 includes a first retaining beam 24 bended downwardly from an inner end of the connecting portion 22 and a mating beam 25 extending from a lower portion of the first retaining beam 24. Said first retaining beam 24 engages into the third groove 143 of the passageway 14, while the mating beam 25 upwardly extends into the receiving room 13 with a spring mating portion 29 formed on a tip end thereof for mating with said mating connector 200.

Said second U-shaped retaining portion 23 includes a second retaining beam 26 bended downwardly from an outer end of the connecting portion 22 and a spring tail portion 27 extends from a lower portion of the second retaining beam 26. The second retaining beam 26 engages into the first groove 141 downwardly and is blocked by the ribs 16 along an outward direction. Said first and second retaining beams 24 and 26 extend downwardly on two sides of the sidewall 11 respectively and connect with each other by the horizontal connecting portion 22, which defines a reverse U-shaped retaining structure to sandwich the sidewall 11. Said tail portion 27 is located away from the sidewalls 11 and further defines a soldering portion 28 bending horizontally from a tip end of the tail portion 27 for being soldered on the first PCB 300. As a result, the soldering portion 28 of the contact 20 is located between a highest point and a lowest point of the contact 20 in a vertical direction. After the electrical connector 100 is mounted on the first PCB 300, a lower part which is located under the soldering portion 28 of the electrical connector 100 sink into a receiving groove 301 of the first PCB 300. The second U-shaped retaining portion 23 is received in the receiving groove 301 and a gap is defined between the tail portion 27 and a side edge of the receiving groove 301 so that the tail portion 27 can be much more flexible.

Figure 3:
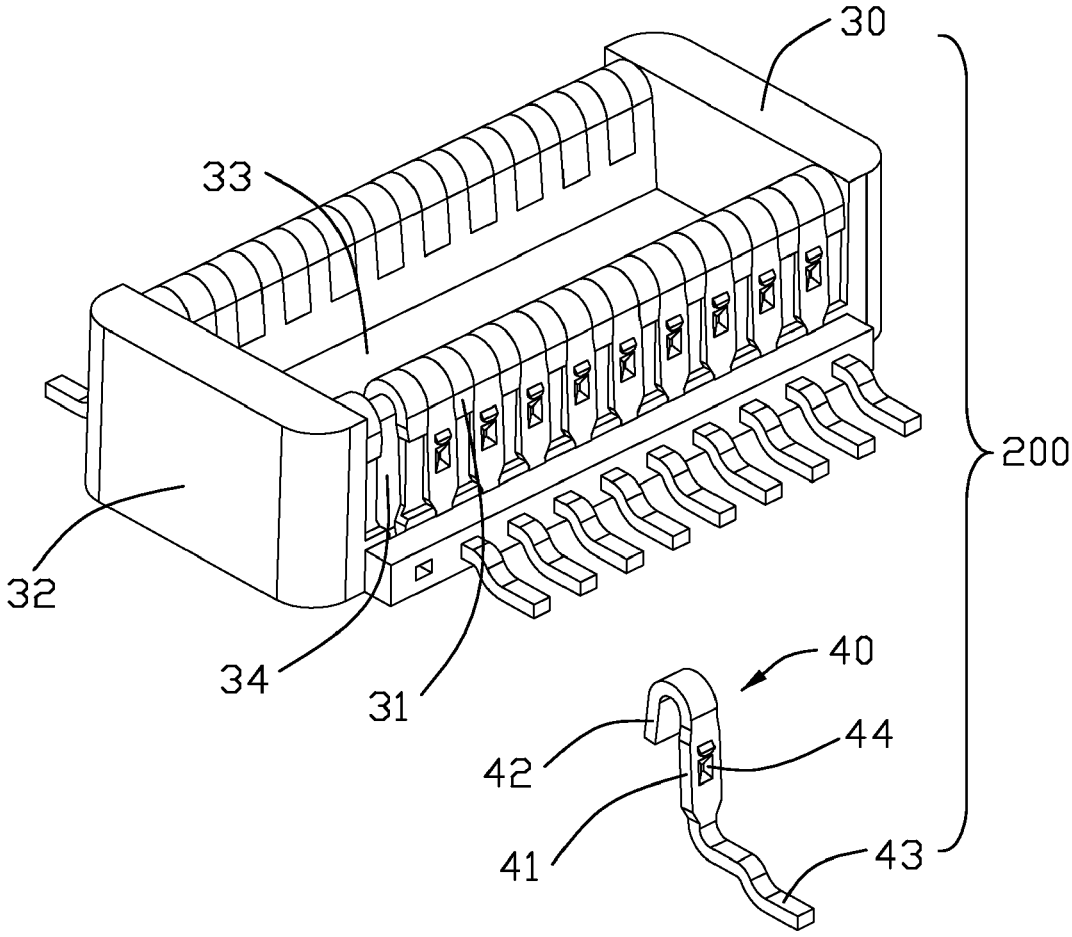
FIG. 3 is a partial exploded perspective view of the other electrical connector of the electrical connector assembly.

In FIG. 3, the mating connector 200 includes an insulating body 30 and a plurality of terminals 40 retained in the insulating body 30. The insulating body 30 has a pair of sidewalls 31 and a pair of end walls 32 which defines a receiving space 33 therebetween. The sidewalls 31 has a plurality of receiving slots 34 on the said sidewalls 31 for receiving said terminals 40. The terminal 40 has a contacting beam 41 located on an outer surface of the sidewalls 31, a holding beam 42 extending upwardly from the contacting beam 41 into the receiving space 33 and a soldering tail 43 extending outwardly from the insulating body 30 for being soldered on the second PCB 400. Said contacting beam 41 has a concave 44 on a surface thereof for engaging with the spring mating portion 29 of the electrical connector 100.

During the assembly process, the first and second U-shaped retaining beam of the electrical connector 100 can provide an enough flexibility to absorb an external shock and adjust the mating process much more smoothly. Moreover, the electrical connector 100 sinks into the receiving groove 301 so that the height of the electrical connector 100 upon the first PCB 300 can be reduced, meanwhile, the distance between the first PCB 300 and the second PCB 400 can also be reduced, which reduces the mating-height of the electrical connector 100 after mating with the mating connector 200.

However, while the preferred embodiment of the invention have been shown and described, it will apparent to those skilled in the art that changes and modifications may be made therein without departing from the spirit of the invention, the scope of which is defined by the appended claims.

What is claimed is:

1. An electrical connector comprising:

an insulating housing having sidewalls and end walls to define a receiving room thereamong;

a plurality of contacts retained in the insulating housing, the contact including a mating beam extending into the receiving room and a retaining beam retained in the sidewall; wherein the contact further includes a tail portion extending out of the insulating housing from the retaining beam and parallel to the retaining beam, said tail portion is located between a highest point and a lowest point of the contact and defines a soldering portion at a tip end thereof;

wherein said retaining beam extends downwardly while the tail portion extends upwardly from a bottom end of the retaining beam;

wherein the electrical connector is retained in a receiving groove of a PCB, said tail portion is received in the receiving groove while the soldering portion extends out of the receiving groove.

2. The electrical connector as claimed in claim 1, wherein said electrical connector is mounted on a first PCB to mate with a mating connector mounted on a second PCB, said tail portion of the contact bends from a lower portion of the retaining beam and then extends toward the second PCB, said soldering portion is located between said two PCBs.

3. The electrical connector as claimed in claim 1, wherein said retaining beam includes a first retaining beam retained on an inner side of the sidewall and a second retaining beam retained on an outer side of the sidewall.

4. The electrical connector as claimed in claim 3, wherein the first retaining beam and the mating beam define a first U-shaped retaining portion located on the inner side of the sidewall, the second retaining beam and the tail portion define a second U-shaped retaining portion located on the outer side of the sidewall, said first and second U-shaped retaining portions are connected by a horizontal connecting portion.

5. The electrical connector as claimed in claim 4, wherein said sidewall defines a plurality of passageways to receive the contacts, said passageway includes a first groove depressed on an outer surface of the sidewall, a second groove extending horizontally on a top surface of the sidewall and a third groove which is depressed on an inner surface of the sidewall.

6. The electrical connector as claimed in claim 5, wherein said first U-shaped retaining portion engages into the first groove downwardly, while the second U-shaped retaining portion engages into the third groove.

7. The electrical connector as claimed in claim 6, wherein every two adjacent passageways are separated by a partition wall, said partition wall defines a pair of ribs extending horizontally into the third groove to stop the second retaining beam from moving out of the third groove.

8. An electrical connector for mating with a mating connector comprising:

an insulating housing defining sidewalls and a mating face on the sidewalls;

a plurality of contacts retained on the sidewalls, the contact comprising a retaining portion abutting against an outer side of the sidewall, a tail portion extending from the retaining portion and a soldering portion extending from the tail portion; wherein the tail portion extends toward the mating face but not beyond the mating face;

wherein the tail portion bend toward the mating face from one end of the retaining portion, said one end of the retaining portion is far from the mating face;

wherein the tail portion is separated from the retaining portion with a gap therebetween;

wherein the soldering portion is parallel to the mating face;

wherein the retaining portion is of a reverse U-shape and ride on the sidewall.

9. A board-to-board connector assembly comprising:

a first connector having a low profile generally rectangular dielectric housing including a mating face and a mounting face for mounting the connector on a first circuit board, the housing defining a receiving space by a pair of longitudinal sidewalls, and transversal end walls;

at least one contact including a retention sandwiched onto one of the sidewalls from atop and including a contact engaging portion extending into the receiving space, and a tail portion spaced from an outer surface of the sidewall, said tail portion including a soldering portion located below a top end of the sidewall and substantially perpendicular to the sidewall; and a printed circuit board defining a cutout into which said first connector is received, wherein the tail portion is essentially located in said cutout and extends upwardly with at a tip thereof the corresponding soldering portion which is seated upon a mounting surface of said printed circuit board.

10. The board-to-board connector assembly as claimed in claim 9, wherein the tail portion bend toward the mating face from one end of the retention, said one end of the retention is far from the mating face.

11. The board-to-board connector assembly as claimed in claim 9, wherein the tail portion is separated from the retention with a gap therebetween.

12. The board-to-board connector assembly as claimed in claim 9, wherein the soldering portion is parallel to the mating face.

13. The board-to-board connector assembly as claimed in claim 9, wherein said tail portion except the corresponding soldering portion, is spaced from the printed circuit board so as to perform flexibility thereof during adjusting coplanarity of the corresponding soldering portion on the mounting surface of the printed circuit board.

* * * * *